United States Patent [19]
Magnuson
[11] 4,326,446
[45] Apr. 27, 1982

[54] LINKAGE OF ACTUATING SYSTEM FOR ELEVATING GUN MOUNT

[75] Inventor: Roland A. Magnuson, Seattle, Wash.

[73] Assignee: The United States of America as represented by the Secretary of the Army, Washington, D.C.

[21] Appl. No.: 95,746

[22] Filed: Nov. 19, 1979

[51] Int. Cl.[3] ..... F41H 7/06
[52] U.S. Cl. ..... 89/38; 89/34; 89/40 B; 89/41 H; 89/45
[58] Field of Search ..... 89/36 M, 37.5 D, 38, 89/39, 40 B, 41 H, 34, 45

[56] References Cited

U.S. PATENT DOCUMENTS 2,348,796 5/1944 Ferwerda et al. ..... 89/40 B
4,065,999 1/1978 Holtgren et al. ..... 89/38

FOREIGN PATENT DOCUMENTS 1548 of 1866 United Kingdom ..... 89/38
4896 of 1890 United Kingdom ..... 89/38

*Primary Examiner*—Stephen C. Bentley
*Attorney, Agent, or Firm*—Peter A. Taucher; John E. McRae; Nathan Edelberg

[57] ABSTRACT

A military vehicle comprising a hull that is equipped with a rotary turret and an external gun thereabove; external power means is provided to elevate the gun bodily and turn the gun in the elevation plane. The gun is equipped with at least one ammunition supply tube that can be periodically replenished from an ammunition storage means in the hull without human assistance (other than actuation of control switches or valves).

3 Claims, 12 Drawing Figures

LINKAGE OF ACTUATING SYSTEM FOR ELEVATING GUN MOUNT

The invention described herein may be manufactured, used, and licensed by or for the Government for governmental purposes without payment to me of any royalty thereon.

BACKGROUND AND SUMMARY OF THE INVENTION

U.S. Pat. Nos. 3,309,962 and 3,401,598 disclose military vehicles having external guns that can be elevated bodily and also turned about the gun pivot axis. In the case of U.S. Pat. No. 3,309,962 the gun-support pedestal is mounted directly on the hull, such that the soldier gunner is seated in a stationary position behind the gun controls. In the case of U.S. Pat. No. 3,401,598 the gun-support pedestal is disposed on a turntable located near the hull bottom wall. In both of these patented arrangements the gun-support mechanism extends into the hull interior, thereby subtracting from otherwise usable space.

The present invention provides an arrangement wherein the power mechanism for elevating the gun is located externally of the hull, namely on the roof of a relatively large turret. Rotation of the turret in the azimuth plane serves to rotate the gun. The turret is large enough to accommodate one or two soldiers, e.g. a gunner and commander.

The gun system preferably includes an ammunition storage means within the forward section of the hull, and at least one ammunition supply tube extending along the underside of the gun for delivering individual rounds to the firing chamber in the aft end of the gun. When necessary the supply tube is replenished with rounds of ammunition by positioning the gun so that the entry end of the supply tube registers with an ammunition delivery opening in the hull upper wall. Conveyor mechanisms in the hull and supply tube are activated to move individual rounds of ammunition from the hull storage area into the supply tube.

The invention is generally directed to a military vehicle that includes an externally adjusted gun that can be automatically loaded and fired without necessity for the soldiers having to expose themselves to enemy fire.

IN THE DRAWINGS

Figure 1:
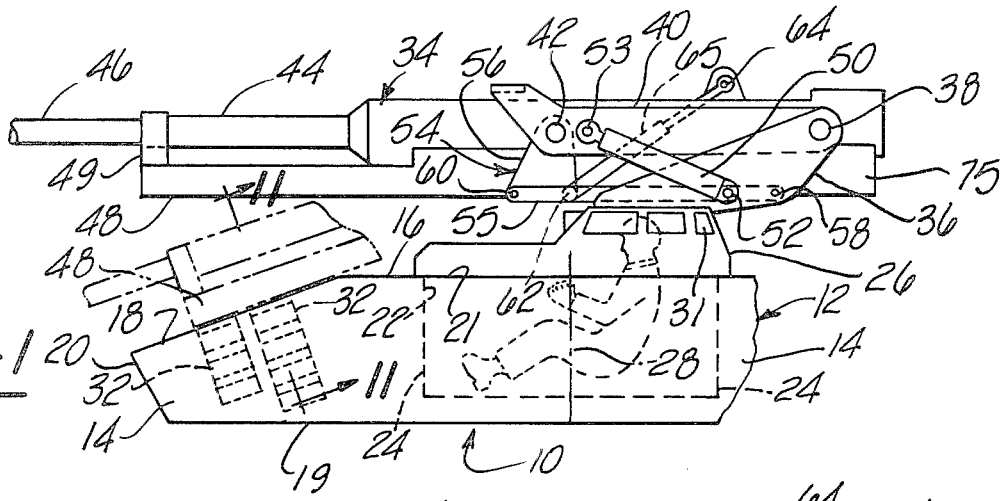
FIGS. 1, 2 and 3 are fragmentary side elevational views of a military vehicle embodying this invention. The various views illustrate different positions of an externally adjusted gun mounted on the vehicle.
Figure 2:
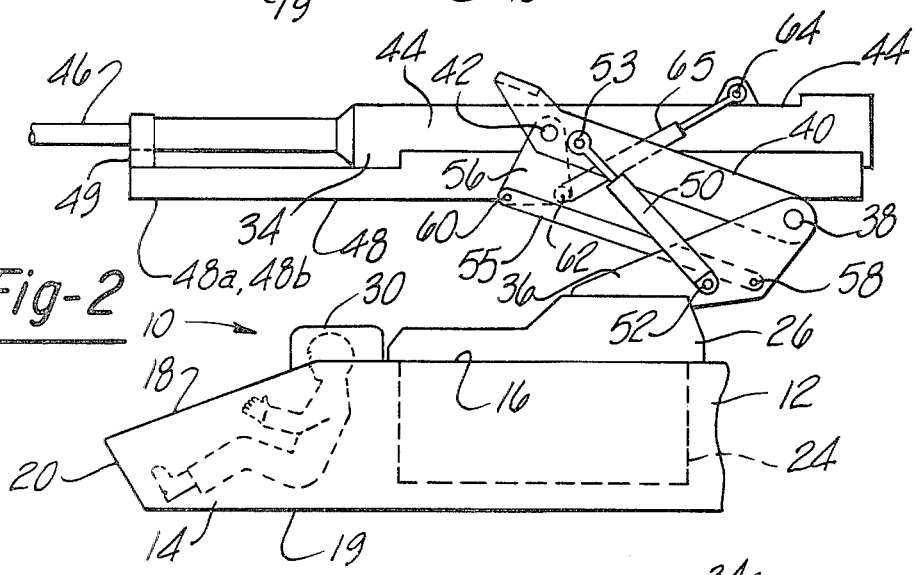
Figure 3:
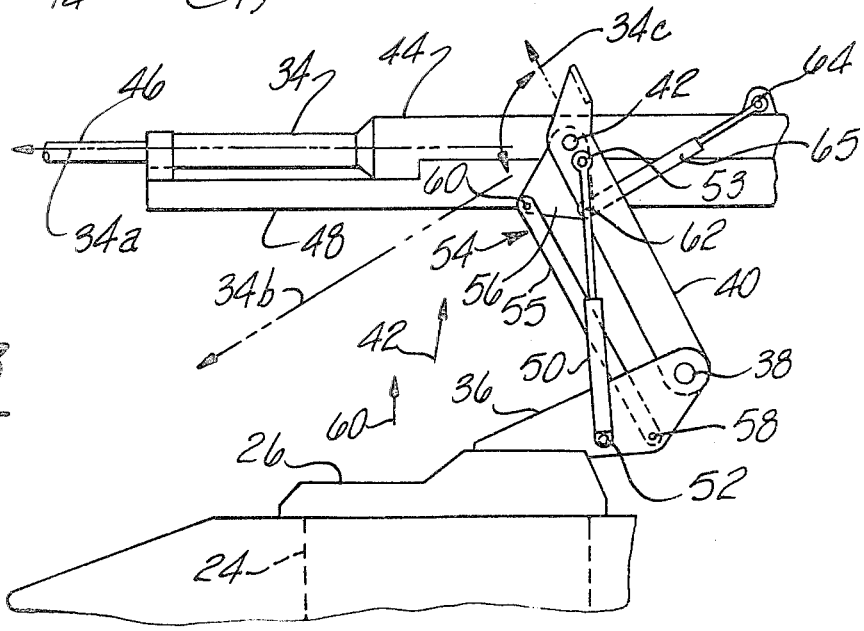

Referring in greater detail to FIGS. 1 through 3, there is shown a tracked military vehicle 10 that includes a hull 12 having a side wall 14 and a top wall 16. Wall 16 includes a sloping forward section 18 connected to a front wall 20 that extends upwardly from a hull bottom wall 19. Hull suspension comprises conventional non-illustrated torsion bars running transversely through the hull along bottom wall 19 to connections with roadarms for the usual track-guidance roadwheels. The propulsion engine and transmission are located in the aft end of the hull, not visible in FIG. 1.

Central section 21 of hull top wall 16 is formed with a large circular opening 22 that accommodates the circular basket 24 of powered turret 26. Conventional motor means, not shown, is arranged within the hull to power the turret in the azimuth plane around its central axis 28. The turret basket is large enough (about sixty three inches in diameter) to accommodate one or two soldiers in a sitting attitude. Viewing windows or periscopes 31 are preferably provided around the periphery of the turret. The driver of the vehicle is seated in a semi-prone position on the left side of the hull near the vehicle front end. An openable hatch 30 equipped with terrain observation windows provides for driver headroom. The hatch is shown in FIG. 2, but is deleted from FIG. 1 in order to better illustrate an ammunition storage means 32 that is located in the right side of the hull near the hull front wall.

The invention is especially concerned with an external power mechanism for bodily elevating a gun 34 from the FIG. 1 lowered position to the FIG. 2 intermediate position to the FIG. 3 fully elevated position. As shown in the drawings, the gun is positioned to fire in a right-to-left direction. The gun is mounted atop the turret; turret rotation is used to target the gun in the azimuth plane. Angular motion of the gun in elevational planes is achieved by a fluid power cylinder mechanism located above the turret.

Figure 12:
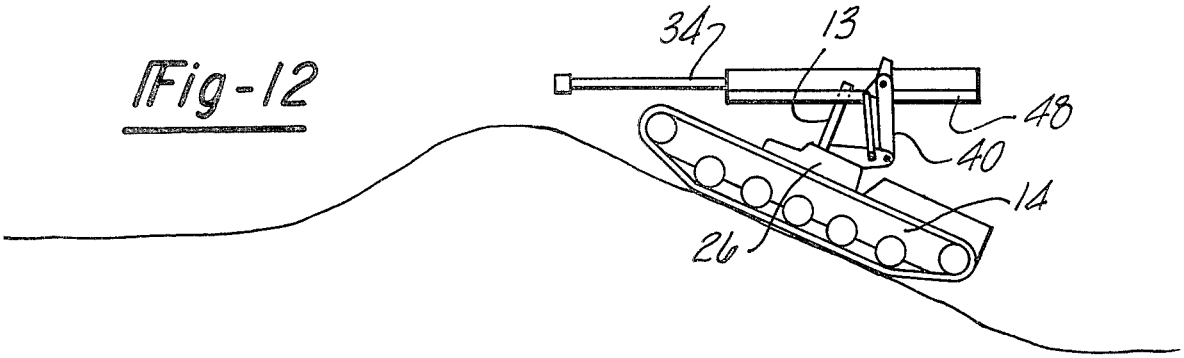
FIG. 12 is a reduced scale side elevational view of the FIG. 1 vehicle in firing position.

Gun 34 is maintained in the FIG. 1 lowered position when it is desired to provide a low vehicle profile for maximum concealment from enemy ground forces; in one contemplated design the turret roof is about sixty three inches above ground level and the gun upper surface is about eighty six inches above ground level when the gun is in the FIG. 1 position. The FIG. 2 intermediate gun position is used primarily when it is desired to fire while the vehicle is moving. The FIG. 3 fully elevated position is used when it is desired to fire the gun from a partially concealed position behind a hill or other fortification, as shown in schematic FIG. 12. FIG. 12 shows a retractible periscope 13 carried by turret 26 to provide gunner visibility of the area to the left of the hill.

The elevated gun position shown in FIG. 3 is useful when it is desired to fire the gun at aircraft; in FIG. 3 the gun direction or attitude is depicted by three directional arrows **34*a* (level), 34*b* (thirty degrees depressed) and 34*c*** (sixty degrees elevated), for enabling the gun to be fired at various targets on the ground or in the air.

FIGS. 1, 2 and 3 illustrate the general features of a mechanism for supporting and adjusting gun 34 in the space above turret 26. The illustrated supportadjustment mechanism is duplicated along the other side of the gun longitudinal axis.

As shown, the mechanism includes a bracket 36 secured to the roof of turret 26, and having a pivot connection 38 with one end of a lever 40. The opposite end of lever 40 has a second pivot connection on pin 42 that projects from receiver portion 44 of gun 34.

Pins 42 are preferably located on the longitudinal center of gravity of gun 34 to minimize the force required to move the gun in elevation planes. Barrel 46 of the gun is slidably mounted in receiver portion 44 for recoil movement in a rightward direction and counter-recoil movement in a leftward direction. The receiver portion of the gun has suspended therefrom an ammunition supply tube system designated generally by numeral 48.

To rotate lever 40 about pivot connection 38 there is provided a first fluid power cylinder 50 having a cylinder pivot connection 52 with bracket 36 and a piston rod pivot connection 53 with lever 40. Introduction of pressurized fluid into the lower right end of the cylinder causes lever 40 to swing upwardly from the FIG. 1 position to the FIG. 3 position.

It is desirable that fluid power cylinder 50 be used solely to raise gun 34 from its FIG. 1 lowered position to its FIG. 3 elevated position without affecting or disturbing the gun direction (shown level in FIGS. 1 through 3). To stabilize the gun in any given direction there is provided a toggle linkage 54 that includes a relatively long link 55 and a relatively short link 56. Link 55 has a pivot connection 58 with bracket 36 and a pivot connection 60 with link 56. Link 56 has a pivotal connection on pin 42 such that the link can pivot relative to gun 34 and lever 40. The various pivot connections 38, 42, 58 and 60 are selected so that imaginary horizontal planes passing through pivots 42 and 60 maintain a given vertical spacing from one another. This constant vertical spacing provides a similar constant vertical spacing between two other imaginary horizontal planes passing through pivot connections 62 and 64 located respectively on link 56 and receiver portion 44 of the gun. A second fluid power cylinder 65 has its cylinder and piston rod trained between these two pivot connections 62 and 64. Accordingly when the first power cylinder 50 is activated and the second power cylinder 65 is de-activated (with its control valve closed) the gun direction will be maintained as the gun is moved bodily upwardly or downwardly between its FIG. 1 and FIG. 3 positions. To change the gun direction in elevation planes cylinder 65 is activated, while cylinder 50 is de-activated. The targeting process can be hastened by simultaneously activating cylinders 50 and 65, while at the same time powering the turret 26 around its rotation axis 28.

It will be noted from FIGS. 1 through 3 that gun 34 is located entirely outside the hull or turret, so that loading of the gun is a problem. In order that the crew be protected from enemy fire it is desirable that the gun be loaded automatically without human assistance; automatic loading requires a supply of ammunition rounds in near adjacency to the barrel of the gun. In the illustrated system this ammunition supply is contained within two parallel tubes 48*a* and 48*b* suitably suspended from receiver 44 by means of straps 49. Preferably tube 48*a* may be used to contain one type of ammunition such as armor piercing, whereas the other tube 48*b* may be used to contain a different type of ammunition such as high-explosive anti-tank. A selector mechanism is associated with the gun to cause the appropriate type of ammunition to be charged into the gun firing chamber in accordance with human decision by the gunner or commander. The gun itself is a known construction not part of the present invention; one suitable gun is a 75 mm hypervelocity automatic cannon designed to interchangeably fire different ammunition rounds. The ammunition may comprise a cartridge containing a propelling charge and projectile, as shown for example in FIG. 17 of U.S. Pat. No. 4,020,740.

Figure 8:
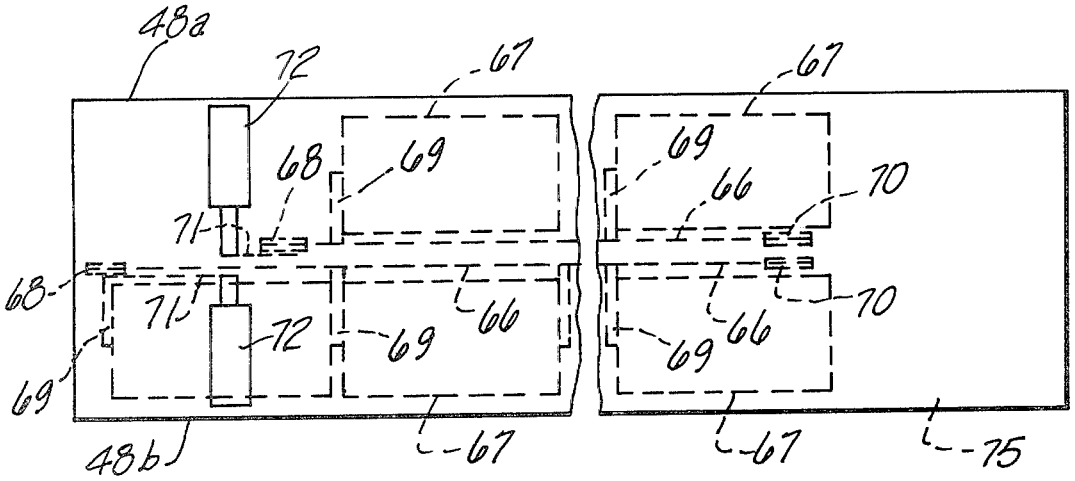
FIG. 8 is a fragmentary top plan view of a feeder mechanism for the FIG. 1 gun.
Figure 9:
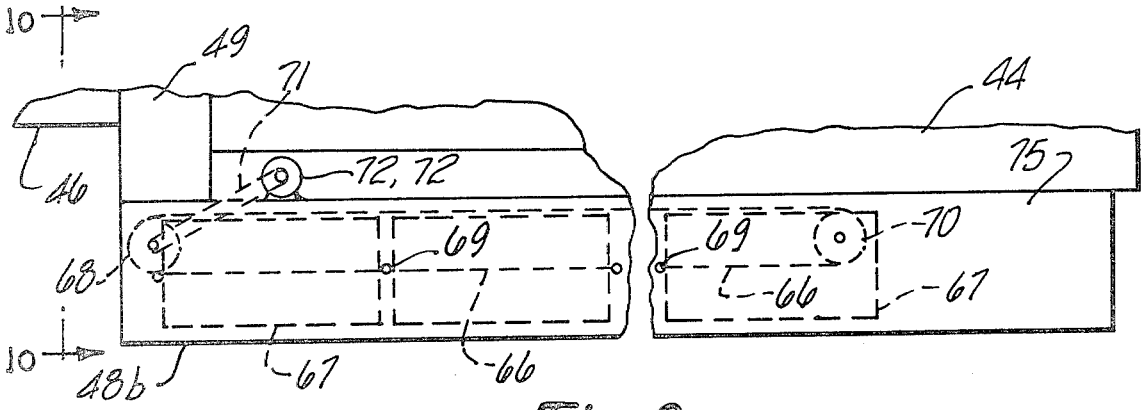
FIG. 9 shows the FIG. 8 mechanism in side elevation.
Figure 10:
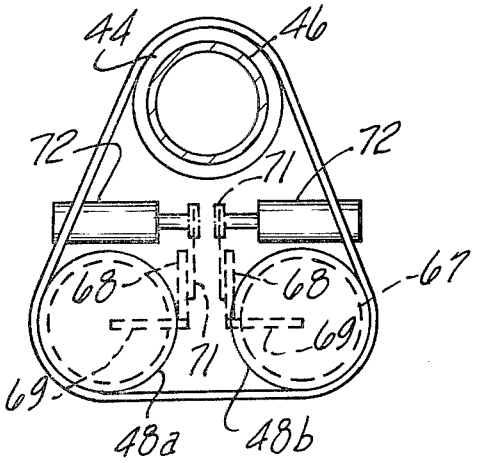
FIG. 10 is a fragmentary sectional view taken on line 10—10 in FIG. 9.

As shown schematically in attached FIGS. 8 through 10, the individual rounds 67 are conveyed or carried along respective ones of the supply tubes by endless chains or belts 66 trained around sprockets 68 and 70 located near opposite ends of the respective tubes. Each chain is equipped with a series of pins 69 that project into the supply tube to propel individual rounds of ammunition rightwardly toward the aft end of the gun. Mechanism for individually powering each conveyor includes a small hydraulic motor 72 that translates a drive chain 71 over a small sprocket attached to the shaft that carries large sprocket 68. Selective energization of each motor 72 for a predetermined time or distance produces the desired motion of the selected ammunition feed chain 66 through the length of one ammunition round.

Individual rounds of ammunition are delivered from supply tubes 48*a* and 48*b* into a gun loader space 75 shown best in FIGS. 4 through 7. Loader space 75 accommodates two individual ammunition transfer arms 77 and 78 rotatably mounted on stationary shafts 79 and 80 disposed along opposite side areas of the receiver 44. The respective transfer arms 77 and 78 may be slightly offset in axial directions for non-interference with each other during movement thereof into the gun firing chamber 82. The aforementioned motors 72 (FIGS. 9 and 10) are operated at alternate time frames so that only one transfer arm 77 or 78 is at any one moment carrying a round of ammunition. The transfer arms are symmetrically positioned on opposite sides of the gun barrel axis, whereby either transfer arm is enabled to deliver a round of ammunition upwardly into the firing chamber 82.

Figure 4:
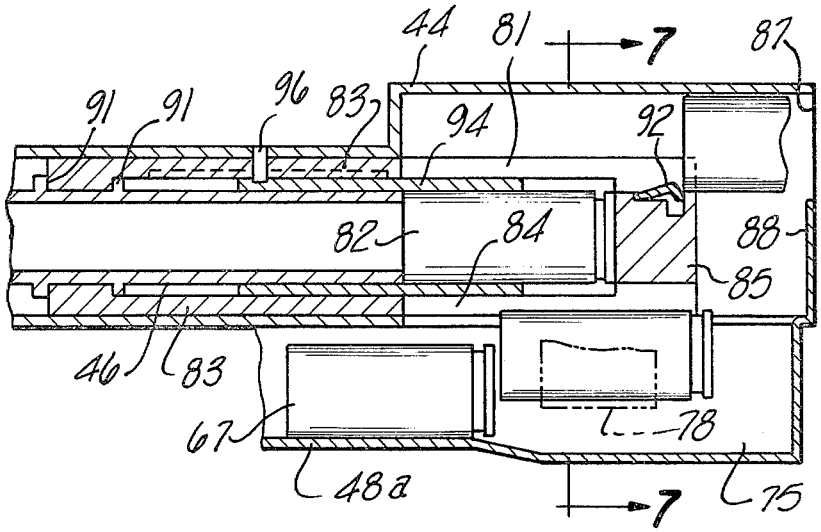
FIGS. 4, 5 and 6 are fragmentary sectional views of the aft end of a gun and ammunition feeder mechanism used in the FIG. 1 vehicle.
Figure 5:
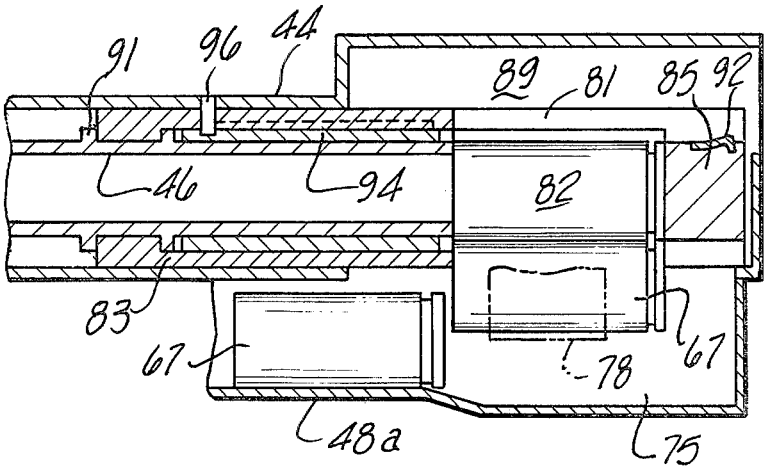
Figure 6:
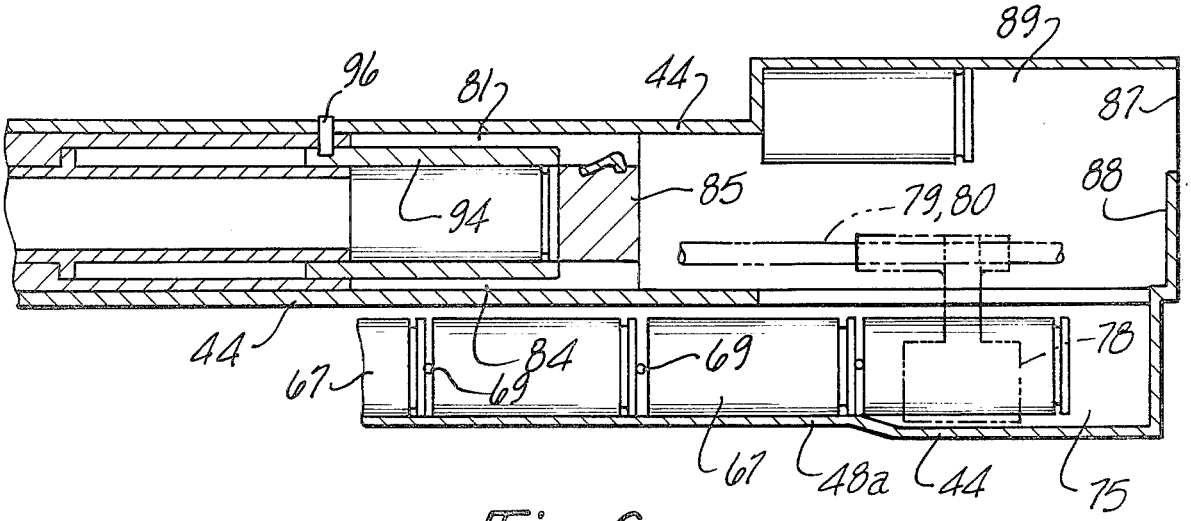

Gun 34 includes a gun barrel 46 having spaced shoulders 91 (FIG. 4) which capture a tubular element 83 for conjoint movement with the barrel. A live ammunition entry slot 84 is provided in a lower section of tubular element 83, and a spent cartridge exit slot 81 is provided in an upper section of tubular element 83; thus live ammunition enters the firing chamber 82 from below, while the spent cartridge is ejected upwardly from the firing chamber. Tubular element 83 includes a relatively thick end wall 85 that defines the rear face of firing chamber 82. FIG. 4 illustrates the gun barrel and attached element 83 during movement in the recoil direction to eject a spent cartridge rightwardly through a circular opening 87 in the rear end wall 88 of stationary receiver 44. FIG. 5 illustrates barrel 46 and attached element 83 at the limit of the recoil movement. FIG. 6 illustrates the gun at its arrival in the battery position suitable for firing a round of ammunition then located in the firing chamber. During gun barrel motion from the FIG. 5 position to the FIG. 6 position the incoming round of ammunition pushes a spent cartridge upwardly into a relief chamber 89 in stationary receiver 44; spring fingers 90 (FIG. 7) temporarily retain the spent cartridge suspended in chamber 89. At the next firing the gun barrel recoils from the FIG. 6 battery position rightwardly toward the FIG. 4 cartridge ejection position. A spring arm 92 on end wall 88 ejects the cartridge through opening 87.

Firing chamber 82 is defined by end wall 85 and a sleeve 94 that is slidably contained in the annular space between barrel 46 and tubular element 83. Sleeve 94 carries a pin 96 that projects through cam slots in element 83 and the stationary receiver 44; additionally sleeve 94 is axially keyed to barrel 46 and element 83. The cam slots are configured so that during recoil movement of the gun barrel the sleeve 94 remains essentially motionless. As the FIG. 5 full recoil position is reached the entry slot 84 in element 83 is fully uncovered to permit transfer arm 77 or 78 to move a live round of ammunition upwardly into the firing chamber 82. Movement in the counterrecoil direction to the FIG. 6 battery position causes sleeve 94 to close the firing chamber, with a round of ammunition trapped therein.

Figure 7:
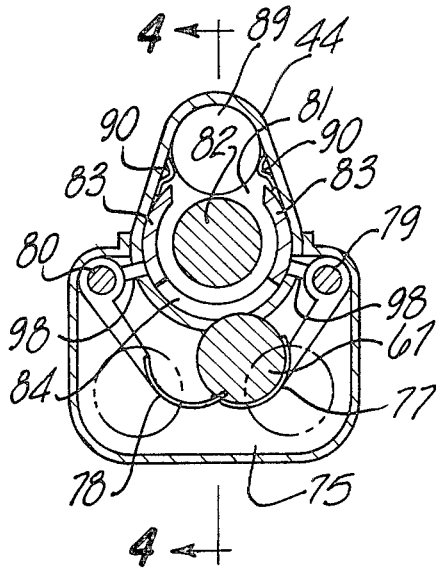
FIG. 7 is a sectional view taken on line 7—7 in FIG. 4.

Ammunition transfer arms 77 and 78 are operated in timed relation to the gun barrel so that live ammunition is delivered from loader space 75 into firing chamber 82 during the time frame between the FIG. 5 recoil position and the battery position. Transfer arms 77 or 78 can be operated by power developed during recoil motion of the gun barrel. As schematically illustrated in FIG. 7, the recoiling sleeve 83 carries pins 98 that project into cam slots in mounting sleeve areas of the transfer arms 77 and 78. The cam slots may be configured to produce upward motions of the transfer arms at the correct points in the cycle.

Figure 11:
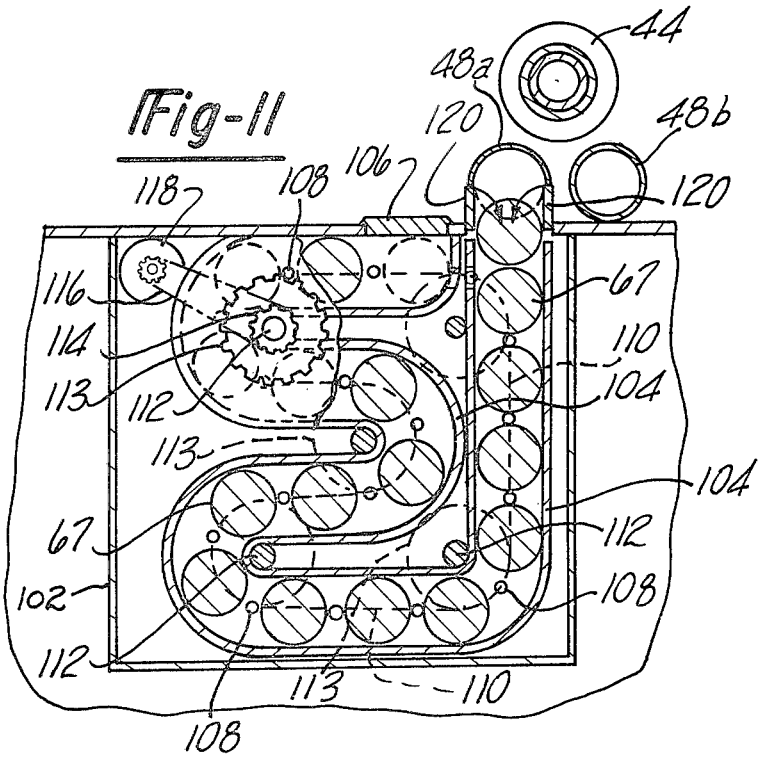
FIG. 11 is a fragmentary enlarged sectional view taken on line 11—11 in FIGS. 1 and 8.

The ammunition supply tubes 48*a* and 48*b* carry a limited number of ammunition rounds. If the firing is sufficiently prolonged to deplete the tubes of ammunition it is then necessary to replenish the tubes with new rounds from storage area 32 (FIG. 1) in hull 14. FIGS. 1 and 11 illustrates the general features of a conveyor mechanism for transferring ammunition from the hull into supply tubes 48*a* and 48*b*. Before the conveyor mechanism is activated it is necessary that fluid power cylinder 65 (FIG. 1) be activated to move gun 34 to the depressed condition shown in dashed lines in FIG. 1.

With gun 34 in a depressed condition the supply tubes 48*a* and 48*b* are located above ammunition delivery openings in the hull top wall 18. Each delivery opening is aligned with a cut-out area of the superjacent supply tube. FIG. 11 illustrates the conveyor system for delivering rounds of ammunition from the hull into supply tube 48*a*. A similar non-illustrated conveyor system is necessary for moving ammunition into tube 48*b*. The FIG. 11 system comprises a container 102 having internal sinuous walls 104 that define a sinuous chute for individual ammunition rounds 67 that are initially loaded through an entry opening closed by a door 106. The individual rounds are separated from one another by individual bars or rods 108 whose opposite ends are connected to endless chains 110. These chains are trained over five individual sprockets 113 carried on rotary support shafts 112. One of these shafts carries an additional sprocket 114 that meshes with a drive chain 116. A small hydraulic motor 118 powers chain 116 and hence the driven sprocket 114 and associated sprocket 113. Limit switches or other control mechanisms are utilized to produce step-like motion of chains 110, sufficient to move individual rounds of ammunition upwardly through a delivery opening formed by hinged doors 120. Chain motion is interrupted when the uppermost ammunition round has advanced completely into the interior of tube 48*a*. At that point in time the motor 72 for tube 48*a* is activated to advance the inserted round along tube 48*a*. Motors 72 and 118 operated in alternating sequence until tube 48*a* is completely filled with ammunition. The various pins 69 (FIG. 9) form a conveyor mechanism for the ammunition in tube 48*a*.

As noted previously, each tube 48*a* or 48*b* is supplied with ammunition from a separate ammunition source in the hull. Numeral 32 in FIG. 1 collectively references these ammunition sources as two rows of ammunition, each equipped with a conveyor mechanism similar to that shown in FIG. 11. Entry openings in supply tubes 48*a* and 48*b* are staggered or offset in accordance with the locations of the respective rows of ammunition in the hull. As previously noted, different types of ammunition may be introduced into the different supply tubes 48*a* and 48*b*, by preselection of ammunition initially introduced through the respective door 106 (FIG. 11).

By way of recapitulation, there is shown a military vehicle 10 that includes a relatively large man-accommodating turret 26 rotatable in the azimuth plane to move the overhead gun 34 around turret rotation axis 28. The gun is bodily elevatable between the FIG. 1 and FIG. 3 positions by activation of fluid cylinders 50. Additionally the gun is rotationally adjustable around pivot axis 42 by activation of two other fluid cylinders 65. Gun movement mechanisms are designed to permit a relatively large swing of the gun around pivot axis 42, thus enabling the gun to be used both for ground targets (other tanks, trucks, fortifications, etc.) and aircraft. The illustrated gun movement mechanism is substantially completely external of the hull and turret (except for the hydraulic pump and accumulator). The fluid cylinders 50 and 65 are located to conjointly resist displacement of the gun receiver 44 in the axial direction; accordingly the gun receiver provides a relatively stable support structure for gun barrel 46 during recoil motion.

The external gun is supplied with ammunition from storage zone 32 in the hull (see FIG. 1). As can be visualized from FIG. 11, individual rounds of ammunition are conveyed upwardly from the hull storage into tubes 48*a* and 48*b* that are suspended from gun receiver 44. After the tubes have been charged with ammunition the gun can be elevated from the FIG. 1 loading position shown in dashed lines. Individual ammunition rounds are translated along tubes 48*a* and 48*b* into transfer arms 77 or 78 preparatory to being charged into the gun firing chamber 82. Movement of ammunition along tubes 48*a* and 48*b* is accomplished by hydraulic motors 72 (FIGS. 8 through 10). Transfer arms 77 and 78 are preferably operated by recoil movement of the gun barrel.

I wish it to be understood that I do not desire to be limited to the exact details of construction shown and described for obvious modifications will occur to a person skilled in the art.

I claim:

1. A military vehicle comprising a hull, a man-accommodating turret mounted on the hull for rotatable movement in the azimuth plane; a gun located about the turret to normally assume a level attitude; a gun elevating lever having a first pivot connection with the turret and a second pivot connection with the gun; first fluid power cylinder means trained between the turret and the gun elevating lever for swinging said lever around the first pivot connection, thereby, changing the elevation point of the second pivot connection, a toggle linkage pivotably trained between the turret and the second pivot connection; a second fluid power cylinder means pivotably trained between the toggle linkage and the gun for swinging said gun around the second pivot connection; said hull having at its frontal end an upper wall that slopes downwardly and forwardly; ammunition storage means within the hull beneath the sloping wall; an ammunition delivery opening in the sloping wall; said gun having at least one ammunition supply tube extending along the undersurface of the gun barrel for delivering ammunition to the aft end of the gun; said supply tube being dimensional so that its forward end registers with the ammunition delivery opening in the sloping wall of the hull when the second power cylinder means is activated to move the gun to an angularly depressed position.

2. The vehicle of claim 1 wherein the ammunition storage means includes a first conveyor for sequentially moving rounds of ammunition through the delivery opening into the aforementioned supply tube.

3. The vehicle of claim 2 further comprising a second conveyor for moving rounds of ammunition through the supply tube toward the aft end of the gun.

* * * * *